United States Patent [19]

Richardson

[11] Patent Number: 4,944,259

[45] Date of Patent: Jul. 31, 1990

[54] ENGINE IGNITION SYSTEM WITH AN INSULATED AND EXTENDABLE EXTENDER

[75] Inventor: Ronald D. Richardson, Pekin, Ill.

[73] Assignee: Caterpillar Inc., Peoria, Ill.

[21] Appl. No.: 280,472

[22] Filed: Dec. 5, 1988

[51] Int. Cl.[5] ..... F02P 15/00

[52] U.S. Cl. ..... 123/169 P A; 123/647; 439/125

[58] Field of Search ..... 123/169 P A, 169 P H, 123/647, 143 R; 439/125, 127

[56] References Cited

U.S. PATENT DOCUMENTS

| | | | |
|---|---|---|---|
| 1,378,260 | 5/1921 | Melton | 123/143 C |
| 2,399,390 | 4/1946 | Robertson | 439/126 |
| 2,686,510 | 8/1954 | Platner | 123/143 C |
| 2,686,511 | 8/1954 | Platner | 123/143 C |
| 3,756,207 | 9/1973 | Davis, Jr. | 123/90.38 |
| 3,792,694 | 2/1974 | Brenholts | 123/635 |
| 3,859,969 | 1/1975 | Davis, Jr. | 123/90.61 |
| 4,221,452 | 9/1980 | Remington | 339/143 S |
| 4,715,337 | 12/1987 | Bohl et al. | 123/169 PA |

FOREIGN PATENT DOCUMENTS

| | | |
|---|---|---|
| 3302878 | 8/1984 | Fed. Rep. of Germany . |
| 831949 | 9/1938 | France . |
| 75450 | 5/1961 | France . |
| 80419 | 3/1963 | France . |
| 556790 | 10/1943 | United Kingdom . |
| 565853 | 11/1944 | United Kingdom . |
| 924974 | 5/1963 | United Kingdom . |

OTHER PUBLICATIONS

Caterpillar Fundamental English (Form REG01497), Sep. 1973, Ignition System, pp. 5–7.

*Primary Examiner*—Andrew M. Dolinar
*Attorney, Agent, or Firm*—J. Wesley Blumenshine

[57] ABSTRACT

An ignition system of an engine has a coil which is spaced away from a spark plug to protect the coil from heat of a combustion chamber and combustion gas leakage. The electrical connections between the coil and spark plug of current design practice have not performed satisfactorily due to loosening of connections, absorption of energy within the connectors and the escape of electrical energy. The present ignition extender overcomes these shortcomings by resiliently biasing the extender between the source of high energy and the spark plug to provide a positive and reliable electrical connection therebetween. Further, the extender is of a relatively rigid construction so as to prevent bending and the problems that can result therefrom. When included in an engine, the extender is combined with a shield to further protect and increase the functional life of the components

9 Claims, 2 Drawing Sheets

ENGINE IGNITION SYSTEM WITH AN INSULATED AND EXTENDABLE EXTENDER

TECHNICAL FIELD

This invention relates generally to spark ignited engines and more particularly to ignition systems having ignition extenders located between a source of high energy and a spark plug.

BACKGROUND ART

Spark ignited engines of today use three primary types of ignition systems between the high energy source and the spark plug. In these three systems the coil is positioned away from the spark plug. The spacing assures that the coil is away from the heat source which can damage and destroy the working capability of the coil.

The first system uses an external coil and a spark plug connected by a high voltage wire lead. When these wires age and become worn, the high energy being transmitted from the coil to the plug can escape or not be transmitted. An open high voltage lead can cause misfires and loss of engine efficiency. Further, the escaping energy can be a shock hazard or, if the engine is located in a high fuel environment, may set off an explosion.

A second system includes an integral coil and an elongated spark plug with a threaded connection between the coil and the spark plug. The threaded connection between the coil and the plug requires a critical alignment therebetween. The location of the plug and coil with reference to interference with other engine components such as intake manifolds, exhaust manifolds and valve covers may cause assembly problems. If improperly assembled the threaded connection can become loose due to engine vibration and allow the high energy being transmitted between the coil and plug to escape causing shock hazards and explosions. Moreover, the elongated spark plugs are constructed with an outer metal case causing the plugs to act as a capacitor. The plugs can absorb between 3000 and 4000 volts rather than conducting this energy to the tip of the igniter.

The third system includes an integral coil with a threaded connection, a spark plug and a threaded extender fixedly attached to the coil and the plug. The alignment problem as discussed earlier also exists and the loosening problem is further enhanced because of an added connection. None of the systems as described above provide for a reliable extension between the coil and spark plug.

One invention directed to overcoming some of the problems set forth above is described in U.S. Pat. No. 4,715,337 (DISCLAIMED), which patent issued to Bohl et al. on Dec. 29, 1987. The '337 patent describes a variable length extender. However, the biasing means of the '337 extender is primarily located in a central portion of the length of the extender, which is also the portion of the extender having the least diameter. Therefore, when the extender is compressed in use, because the central portion of the extender does not have a rigid core running therethrough and is also of a relatively small diameter, the extender is susceptible to bending in this central portion. If the extender does bend, the electrical conducting internal members of the extender are brought closer to the wall of the spark plug well and it becomes more probable that the electrical potential on the central conductor will pierce the insulator and arc over to the wall and short circuit the system. Further, when bent, the insulator of the extender may crack, creating an opening for the electricity to arc with the wall of the spark plug well.

The present invention is directed to overcoming one or more of the problems as set forth above.

DISCLOSURE OF THE INVENTION

In one aspect of the invention an ignition extender is adapted for use in an engine to connect between a spark plug and a source of high energy.

The extender comprises a tubular insulating member fixedly attached to and surrounding at least a portion of an electrically conductive rigid metal core, the core having a first end for receiving an electrical charge and a second end for transmitting the electrical charge, the core being at least 6 millimeters in diameter and at least 7.5 centimeters long with at least 3.6 centimeters of the core being on each side of the lateral centerline of the extender, a first terminal for receiving the charge from the energy source and transmitting the charge to the first end of the core, and a second terminal for receiving the charge from the second end of the core and transmitting the charge to the spark plug, one of the terminals being axially moveable with respect to the core.

In an alternative embodiment, the core may not be rigid but the insulator has a diameter of 20 millimeters along a 10 centimeter length of the insulator extending at least 5 centimeters on each side of the lateral centerline of the insulator in order to provide rigidity.

In another aspect of the present invention, an insulated ignition system is provided for use in an engine having a combustion chamber and a cover attached to the engine with a spark plug well therebetween. The ignition system comprises a spark plug extending into the combustion chamber, a source of high energy, a shield extending between and sealably connected to the cover and the engine and having an axially extending passage between the source of high energy and the spark plug, and an insulated, resiliently biased extendable ignition extender disposed in electrical conducting contact with the source of high energy and the spark plug and positioned within the passage of the shield.

The present invention provides an extender which is insulated and resiliently biased extendably between the spark plug and the source of high energy. Furthermore, the biased terminal and core and the insulating member provide a positive electrical contact between the spark plug and the source of high energy while guarding against arcing, shock hazards and explosions.

BEST MODE FOR CARRYING OUT THE INVENTION

Figure 1:
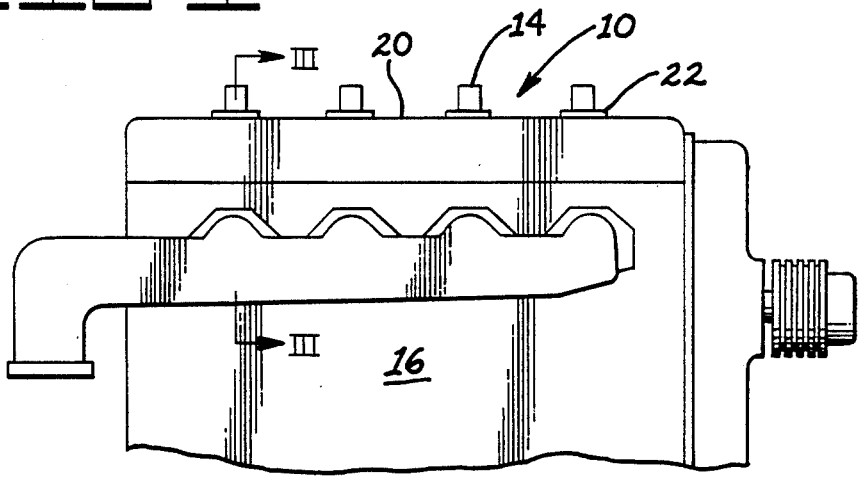
FIG. 1 is a profile view of an engine illustrating an ignition system using the extender.
Figure 4:
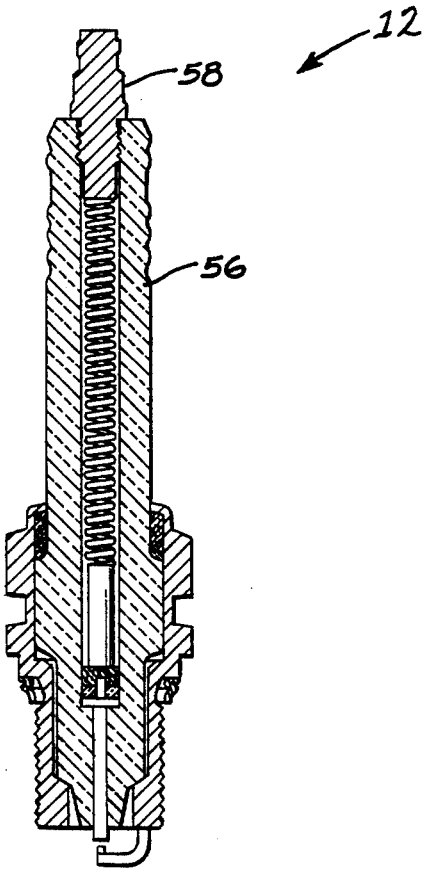
FIG. 4 is an enlarged section view of a spark plug taken through the axial centerline of the spark plug.
Figure 2:
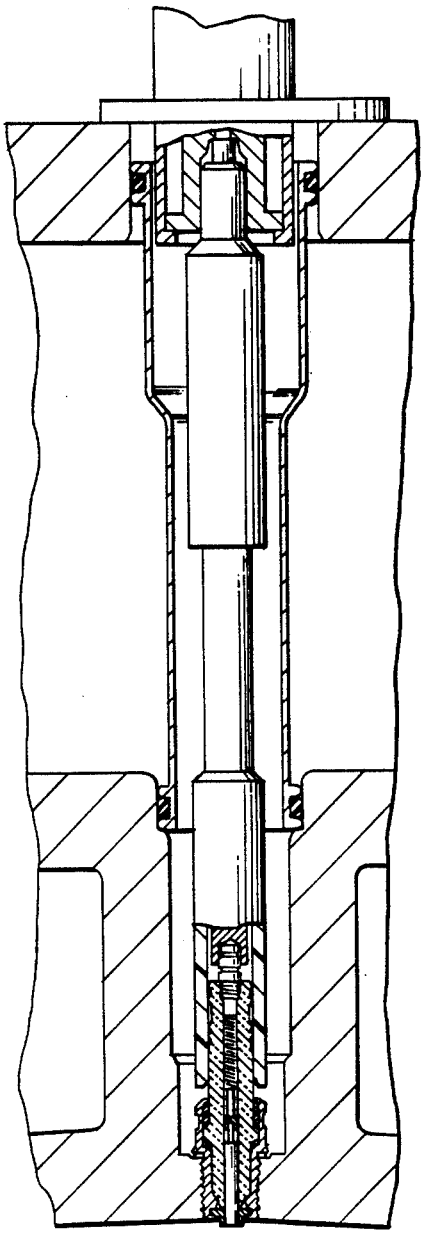
FIG-2 PRIOR ART
FIG. 2 is a prior art depiction of an insulated ignition extender in the engine depicted in FIG. 1 as they would appear in a partial section taken along the line III—III of FIG. 1.

Referring now to FIGS. 1 and 2, an ignition system 10 having a spark plug 12 and a source of high energy 14 or a conventional ignition coil is shown used with an engine 16. The engine 16 is of a conventional spark ignited configuration and includes a spark plug well 32 having a first end 52 and a second end 54, a combustion chamber 18 wherein the spark plug 12 is mounted at the second end 54 of the spark plug well 32 and extends into the combustion chamber 18, and a cover 20 attached to the engine 16. The engine 16 also includes a tank for holding a supply of fuel and a means for feeding the fuel from the tank to the combustion chamber 18.

Figure 3:
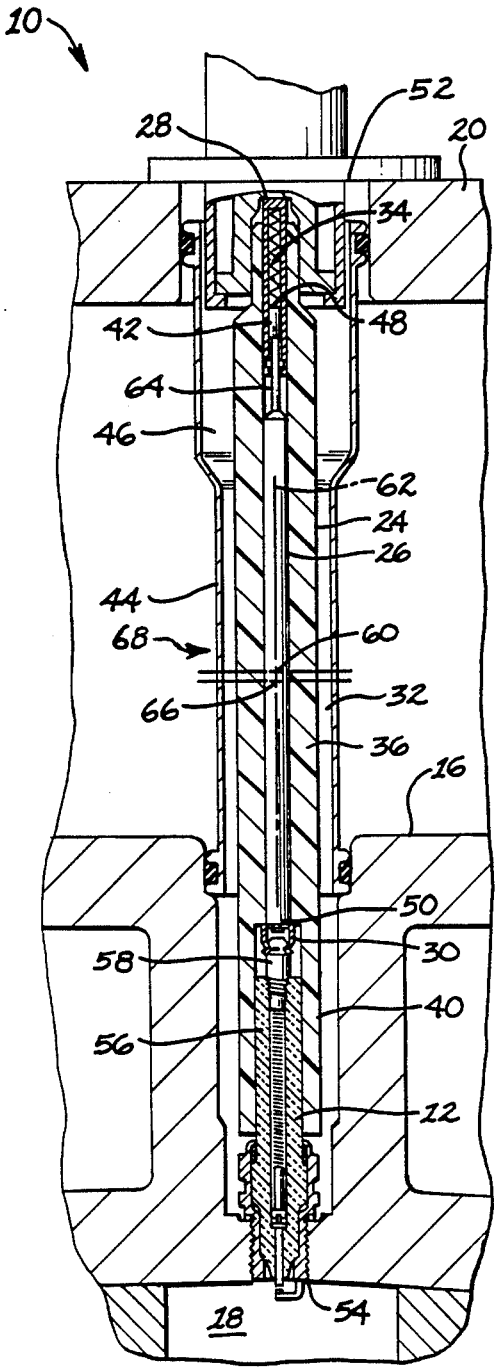
FIG. 3 is a partial section taken along the line III—III of FIG. 1.

The ignition system 10 includes an insulated ignition extender 24 which is best shown in FIG. 3. Such extenders 24 have been specifically adapted for use in gaseous methane burning engines 16 requiring a voltage of at least 8000 volts in order to ignite the methane and having a spark plug well 32 length of at least 25 centimeters. The extender 24 has an axial centerline 62 which runs from one end of the extender 24 to the other end through the center of the extender 24 and a longitudinal midpoint 60 located halfway between the ends of the extender 24. The extender 24 is connected between the spark plug 12 and the coil 14. The extender 24 comprises a core 26 having a first end 48 and a second end 50. At the first end 48 of the core 26 is a first terminal 28 and at the second end 50 of the core 26 is a second terminal 30. The first terminal 28 is for receiving electrical charge from the energy source 14 and transmitting the electrical charge to the first end 48 of the core 26. The electrical charge flows through the core 26 to the second end 50 of the core 26 and into the second terminal 30. The second terminal 30 receives the electrical charge and transmits the electrical charge to the spark plug 12.

The extender 24 further comprises an insulator 36 that is fixedly attached to and surrounds at least a portion of the core 26. A preferred material for the insulator 36 is a polytetrafluoroethylene material although other materials having similar insulating and thermal qualities can be used. Preferably the insulator 36 surrounds a major portion of the core 26 and more preferably the entire core 26. The insulator 36 prevents the electrical charge from arcing from the core 26 to other electrically conductive members such as the wall of the spark plug well 32. The insulator 36 has a protrusion 40 which protrudes beyond the second terminal 30 and surrounds the spark plug insulator 56. Preferably, the protrusion covers the entire insulator 56 of the spark plug 12. An extender 24 of the type herein described and shown has been specifically adapted for use with a spark plug 12 having an insulator 56 of about 5.2 centimeters. The insulator 56 of the spark plug 12 is measured upward from the top of the metal shell of the spark plug 12 to the end of the insulator 56. In such an embodiment, the protrusion 40 extends beyond the second terminal 30 about 5.2 centimeters so as to substantially cover the spark plug insulator 56.

It is an important aspect of the present invention that the extender 24 have a relatively high resistance to bending when subjected to an axial force. By not bending, the electrical conducting members of the extender 24 remain an initial distance from the wall of the spark plug well 32 when the extender 24 is placed in the engine 16 between the cover 20 and the spark plug 12. This distance can be calculated and designed into the engine 16 as the distance necessary to assure that electricity under a certain voltage will travel through the extender 24 to the spark plug 12 rather than arcing from the core 26 through the insulator 36 to the wall of the spark plug well 32. Of course, this distance is a function of the thickness and dielectric strength of the insulator wall 38, the voltage, temperature, atmosphere, and other variables. However, it is clear that whatever the distance is determined to be, if the extender 24 bends, the distance becomes shorter and it becomes easier for the electricity to arc from the core 26 to the wall of the spark plug well 32. Therefore, it is important that the extender 24 be designed so as to have a relatively high resistance to bending.

The extender 24 is most susceptible to bending or buckling along a central portion of the extender 24 at or near the longitudinal midpoint 60. Therefore, in order to increase the bending resistance of the extender 24, this central portion of the extender 24 must be stiffened or made more rigid. One way to stiffen the extender 24 is to position the core 26 in this central portion of the extender 24. In a preferred embodiment, the core 26 is at least 6 millimeters in diameter and at least 7.5 centimeters long with at least 3.6 centimeters of the core 26 being on each side of the longitudinal midpoint 60 of the extender 24. Also, better stiffness is obtained if the core 26 is at least four-tenths as long as the extender 24 and at least three-tenths of the core 26 is on each side of the longitudinal midpoint 60 of the extender 24. Preferably, for better stiffness and electrical conductivity, the core 26 is a single piece of metal having a solid cross-section. Acceptable metals include brass, copper, aluminum and other conductive metals. However, the core 26 could be hollow or pieced together or other configurations or materials so long as sufficient stiffness and electrical conductivity is provided.

Another way to make the extender 24 stiffer, whether or not the core 26 is rigid as described above, is to have the insulator 36 provide adequate stiffness to the extender 24. Again, because it is the central portion of the extender 24 that must be stiff, it is a longitudinal central portion 68 of the insulator 36 that must be stiff. It has been found that an insulator 36 having a diameter of at least 20 millimeters along at least a 10 centimeter length of the insulator 36 extending at least 5 centimeters on each side of the longitudinal midpoint 66 of the insulator 36 will provide sufficient stiffness to the extender 24. Preferably, in order to increase stiffness and inhibit arcing, the of the insulator 36 will have a thickness of at least 5 millimeters along this 10 centimeter length. The longitudinal midpoint 66 of the insulator 36 is halfway between the insulator's 36 ends.

The extender 24 further comprises means 34 for axially biasing apart at least one of the terminals 28 and 30 from the core 26 and for providing the electrical connection therebetween. The biasing and providing means 34 assures that positive electrical contact is maintained between the first terminal 28 and the energy source 14. In this embodiment, the biasing means 34 is a compression spring made of electrical conducting material and is fitted between the first terminal 28 and the first end 48 of the core 26.

In this embodiment, the first terminal 28 is a capped tubular member which confines the compression spring 34. The core 26 has a spindle conductor 64 and a stationary conductor 42. In this embodiment, the spindle and stationary conductors 64 and 42 are separate members which are in electrical contact with the core 26, however, the spindle and stationary conductors 64 and 42 could alternatively be unitary with and formed with the rest of the core 26. The first terminal 28 has a non-metallic snap ring at its open end which slides along the spindle conductor 64. The snap ring of the terminal 28 slides between the stationary conductor 42 and the larger diameter part of the core 26. The stationary conductor 42 retains the first terminal 28 from being released. Thus, the first terminal 28 can move axially a distance equal to the distance the snap ring can slide along the spindle conductor 64. The terminals 28 and 30 and the core 26 may be made of aluminum, copper, brass, tin plated brass or other electrical conductors.

In this embodiment, the second terminal 30 is not co-extensive with the second end 50 of the core 26 but the second terminal 30 is stationary. The second terminal 30 is a threaded (male) clip that is screwed into the bored and threaded (female) second end 50 of the core 26. The clip firmly attaches to the electrode 58 of the spark plug 12 to create a good electrical connection therebetween. In this embodiment, the first and second terminals 28 and 30 are separate and distinct from the first and second ends 48 and 50 of the core 26. However, in alternative embodiments, one of the first or second ends 48 and 50 of the core 26 may actually serve as the first or second terminal 28 and 30, respectively. Of course, in such an embodiment, such a terminal could not be biased apart from the core 26 since the terminal would actually be a part of the core 26. Therefore, because at least one of the terminals 28 and 30 must be biasable apart from the core 26, only one terminal 28 or 30 may be co-extensive with and synonymous with an end 48 or 50 of the core 26.

Further, included with the extender 24 when used with the engine 16 is a shield 44 extending between and sealably connected to the cover 20 and the engine 16. The shield 44 is made of a metallic material which is in frictional contact with the cover 20 and the engine 16. A passage 46 is provided substantially axially concentric with the spark plug 12 and the coil 14 within the shield 44.

As an alternative, the extender 24 could be used with a diesel or turbine engine using a glow plug or another type of igniter.

INDUSTRIAL APPLICABILITY

During operation of the spark ignited engine 16, a flow of electrical energy passes from the coil 14 to the first terminal 28 through the compression spring 34 through the core 26 then through the second terminal 30 to the spark plug 12. The spark plug 12 produces a spark and ignites the combustible mixture in the combustion chamber 18. The compression spring 34 exerts an axial force between the first terminal 28 and the core 26 providing positive electrical contact between the coil 14 and the core 26. The insulator 36 ensures that substantially all of the electrical energy passes through the electrical conducting members of the extender 24 to the spark plug 12. The protrusion 40 of the spark plug 12 prevents loss of energy and arcing between the spark plug electrode 58 and the environment.

The shield 44 is assembled between the cover 20 and the engine 16 to isolate the coil 14, extender 24 and the spark plug 12 from the environment. The shield 44 is in frictional contact by the use of o-ring seals with the cover 20 and the engine 16 so that possible explosions within the passage 46 are substantially confined therein.

The ignition extender 24 set forth above provides an arrangement ensuring that substantially all of the energy is transmitted from the coil 14 to the spark plug 12. The biasing and providing means 34 ensures that positive electrical contact is made and maintained between the core 26 and the coil 14.

Other aspects, objects and advantages of this invention can be obtained from a study of the drawings, the disclosure and the appended claims.

I claim:

1. A spark plug extender for use in a spark ignited engine for conducting an electrical charge from an energy source to a spark plug, comprising:

a tubular insulating member fixedly attached to and surrounding at least a portion of an electrically conductive core;

said core having a first end for receiving said electrical charge and a second end for transmitting said electrical charge, said core being at least 6 millimeters in diameter and at least 7.5 centimeters long with at least 3.6 centimeters of said core being on each side of the longitudinal midpoint of said extender;

a first terminal for receiving said electrical charge from said energy source and transmitting said charge to said first end of said core; and a second terminal for receiving said electrical charge from said second end of said core and transmitting said charge to said spark plug;

one of said terminals being axially moveable with respect to said core.

2. The spark plug extender as claimed in claim 1, further comprising means for axially biasing apart said one of said terminals from said core and for providing an electrical connection between said one of said terminals and said core.

3. The spark plug extender as claimed in claim 2, wherein said core is at least four-tenths as long as said extender and at least three-tenths of said core is on each side of the longitudinal midpoint of said extender.

4. The spark plug extender as claimed in claim 3, wherein said core is metal and has a solid cross-section.

5. A spark plug extender for use in a spark ignited engine for conducting an electrical charge from an energy source to a spark plug, comprising:

an electrically conductive core having a first end for receiving said electrical charge and a second end for transmitting said electrical charge;

a tubular insulating member fixedly attached to and surrounding at least a portion of said electrically conductive core, said insulator having a longitudinal central portion extending at least 5 centimeters on each side of the longitudinal midpoint of said insulator, said central portion having an effective diameter of at least 20 millimeters;

a first terminal for receiving said electrical charge from said energy source and transmitting said charge to said first end of said core;

a second terminal for receiving said electrical charge from said second end of said core and transmitting said charge to said spark plug;

one of said terminals being axially moveable with respect to said core; and a compression spring for axially biasing apart said one of said terminal from said core and for providing an electrical connection between said one of said terminals and said core;

wherein said compression spring is entirely confined between the longitudinal midpoint of said extender and one of said first or second terminals of said extenders.

6. The spark plug extender as claimed in claim 5, wherein said central portion of said insulator has a thickness of at least 5 millimeters.

7. A spark ignited engine adapted for combusting a fuel requiring a voltage of at least 8000 volts to ignite the same, said engine including a spark plug well having a length of at least 25 centimeters, said spark plug well having a first end and a second end adjacent a combustion chamber of said engine, a spark plug mounted at said second end of said spark plug well, and a spark plug extender extending form said spark plug toward said first end of said spark plug well, said engine characterized in that:

said spark plug has an insulator having a length of at least 5.2 centimeters; and said spark plug extender has:

an electrically conductive core having a first end for receiving said electrical charge and a second end for transmitting said electrical charge, said core being at least 6 millimeters in diameter and at least 7.5 centimeters long with at least 3.6 centimeters of said core being on each side of the longitudinal midpoint of said extender;

a tubular insulating member fixedly attached to and surrounding at least a portion of said electrically conductive core;

a first terminal for receiving said electrical charge from said energy source and transmitting said charge to said first end of said core;

a second terminal for receiving said electrical charge from said second end of said core and transmitting said charge to said spark plug;

one of said terminals being axially moveable with respect to said core; and a protrusion extending at least 5.2 centimeters beyond said second terminal so as to substantially cover said spark plug insulator.

8. The spark ignited engine as claimed in claim 7, wherein said fuel is a gaseous fuel comprised primarily of methane.

9. A spark plug extender for use in a spark ignited engine for conducting an electrical charge from an energy source to a spark plug, comprising:

an electrically conductive core having a first end for receiving said electrical charge and a second end for transmitting said electrical charge;

a tubular insulating member fixedly attached to and surrounding at least a portion of said electrically conductive core, said insulator having a longitudinal central portion extending at least 5 centimeters on each side of the longitudinal midpoint of said insulator, said central portion having an effective diameter of at least 20 millimeters;

a first terminal for receiving said electrical charge from said energy source and transmitting said charge to said first end of said core;

a second terminal for receiving said electrical charge from said second end of said core and transmitting said charge to said spark plug;

one of said terminals being axially moveable with respect to said core; and means for axially biasing apart said one of said terminals from said core;

wherein said biasing means is entirely confined between the longitudinal midpoint of said extender and one of said first or second terminals of said extender.

* * * * *